United States Patent [19]

Kitamura

[11] Patent Number: 4,459,893

[45] Date of Patent: Jul. 17, 1984

[54] INSTANTANEOUS ROTATION DEVICE

[75] Inventor: Yoshio Kitamura, Nagano, Japan

[73] Assignee: Kabushiki Kaisha Sankyo Seiki Seisakusho, Nagano, Japan

[21] Appl. No.: 426,058

[22] Filed: Sep. 28, 1982

[30] Foreign Application Priority Data

Oct. 2, 1981 [JP] Japan ..... 56-146031[U]

[51] Int. Cl.[3] ..... G10F 1/06

[52] U.S. Cl. ..... 84/95 C

[58] Field of Search ..... 84/94 R, 94 L, 95 R, 84/95 C, 96, 97, 98, 99, 100, 101; 74/116, 118, 119, 122, 142; 46/146

[56] References Cited

U.S. PATENT DOCUMENTS

| | | | |
|---|---|---|---|
| 415,034 | 11/1889 | Gautschi | 84/95 R |
| 459,970 | 9/1891 | VanFleet | 84/95 R |
| 526,499 | 9/1894 | Paillard et al. | 84/95 R |
| 1,735,923 | 11/1928 | Helgeby | 74/116 |
| 3,037,779 | 4/1959 | Duncan | 46/146 |

*Primary Examiner*—L. T. Hix
*Assistant Examiner*—Brian W. Brown
*Attorney, Agent, or Firm*—Sughrue, Mion, Zinn, Macpeak and Seas

[57] ABSTRACT

An instantaneous rotation device for a jack-in-the-box type music box comprises a gear adapted to be driven by a power source, an abutting portion formed on said gear, a dog rotatably provided to the gear and having a projection, a spring for biasing the projection into abutment with the abutting portion, a stationary limiting member projecting into a path of rotation of the projection, a cam member for eccentrically moving the projection out of engagement with the stationary limiting member, and a movable member biased to project into the path of rotation of the projection ahead of the limiting member in the direction of rotation of the gear. As the projection abuts against the limiting member, the spring is energized, and as the projection is released from the limiting member by the cam member, the projection instantaneously rotates the movable member by making use of the energy stored in the spring.

9 Claims, 11 Drawing Figures

INSTANTANEOUS ROTATION DEVICE

BACKGROUND OF THE INVENTION

The present invention relates to an instantaneous rotation device suitable for use in various apparatus including small apparatus such as music box and large apparatus.

A description will be made hereinunder as to two examples of the prior art which have suffered various problems due to the unavailability of instantaneous rotation device to which the invention pertains. FIG. 1 shows a jack-in-the-box incorporating a music box. The jack-in-the-box 1 accomodates a head 2 of a doll fixed to one end of a coiled spring 3. A lid 50 presses the head 2 to prevent the later from springing out of the box 1. The lid 50 is retained by a hook 6 provided at one end of a rotary member 5. The other end of the rotary member is made to oppose to a projection 52 carried by a belt 53 which carries also pins 51 adapted to pluck the vibration plates 18 of the music box. The belt 53 is adapted to be rotated by means of a handle 11. The lid of the box is opened as the handle 11 is rotated. This arrangement suffers the following disadvantage. Namely, when the handle 11 is rotated at a dead slow speed, the rotary member 5 is rotated by the projection 52 so that the lid 50 is opened but, inversely when the opening, it cannot be latched by the hook 6 of the rotary member 5 because, due to dead slow movement of the belt, the projection 52 still takes such a position as to push the rotary member 5.

FIG. 2 shows a music box adapted to play two different musics by a single drum. An elongated hole 54 formed in the gear 16 coaxial with the drum 15 loosely receives a support shaft 55 fixed to the drum. A cam wheel 58 having a plurality of claws 56 and cams 57 fits around the support shaft. The drum 15 is biased by the spring 31 towards the gear 16. A pin 37 is fixed to the portion of the drum 15 adjacent to the cam wheel 58. As the gear 16 rotates, the drum 15 and the cam wheel 58 are rotated. A cam wheel rotating claw 59 fixed to a stationary member is made to project to the ends of the claws 56 of the cam wheel 58 so that, as the cam wheel 58 is rotated about its own axis with the axis being rotated, the cam 57 moves the pin 37 and the drum 15 in the axial direction to permit the playing of two different musics. According to this arrangement, about 20° per unit rotation (360°) is used for the switching of the music so that the playing is suspended undesirably for about 1.4 second. Therefore, in order to play one full music in two rotations of the drum, it is not possible to play the music continuously with the loss time of 1.4 second.

SUMMARY OF THE INVENTION

Accordingly, an object of the invention is to provide an instantaneous rotation device capable of instantaneously rotating the movable member thereby to obviate the abovedescribed problems of the prior art.

According to the invention, there is provided an instantaneous rotation device comprising: a gear adapted to be driven by a power source; an abutting portion formed on said gear; a dog rotatably provided to said gear and having a projection; means for biasing said projection into abutment with said abutting portion; a stationary limiting member projecting into a path of rotation of said projection; means for eccentrically moving said projection out of engagement with said stationary limiting member; and a movable member biased to project into the path of rotation of said projection ahead of said limiting member in the direction of rotation of said gear; wherein as said projection abuts against said limiting member, said biasing means is energized, and as said projection is released from said limiting member by said eccentrically moving means, said projection instantaneously rotates said movable member by making use of the energy stored in said biasing means.

DESCRIPTION OF THE PREFERRED EMBODIMENTS

Figure 2A:
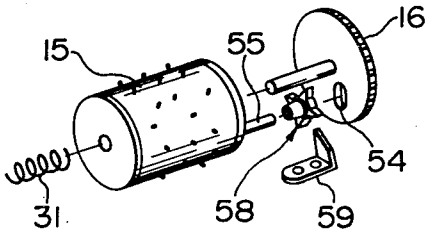
FIG. 2a PRIOR ART
FIG. 2 illustrates a conventional music switching mechanism of a music box incorporating a cam wheel.
Figure 2B:
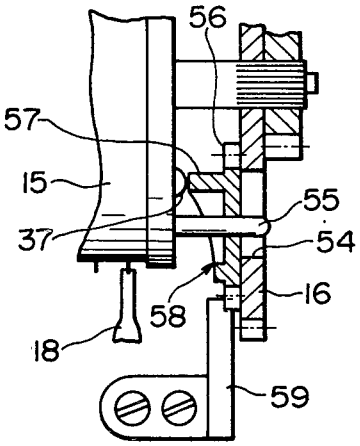
FIG. 2b PRIOR ART
Figure 1:
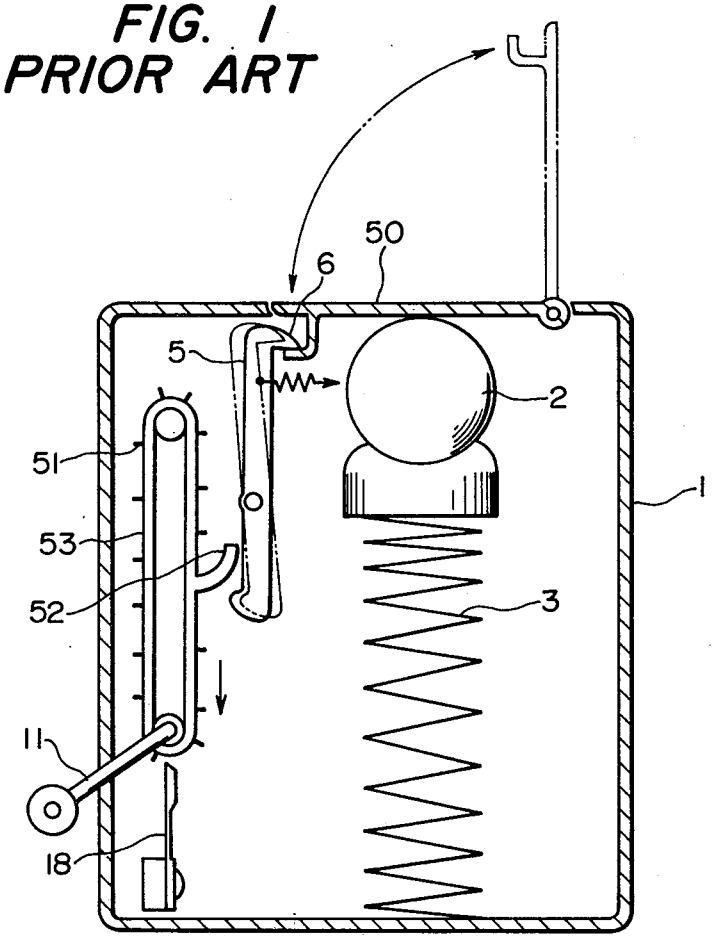
FIG. 1 PRIOR ART
FIG. 1 is a sectional view explanatory of the construction of a conventional jack-in-the-box with a music box, incorporating a movable member.
Figure 3:
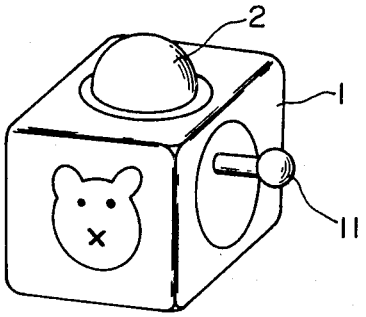
FIG. 3 is a perspective view of a jack-in-the-box with a music box, incorporating an instantaneous rotation device in accordance with the invention.
Figure 4:
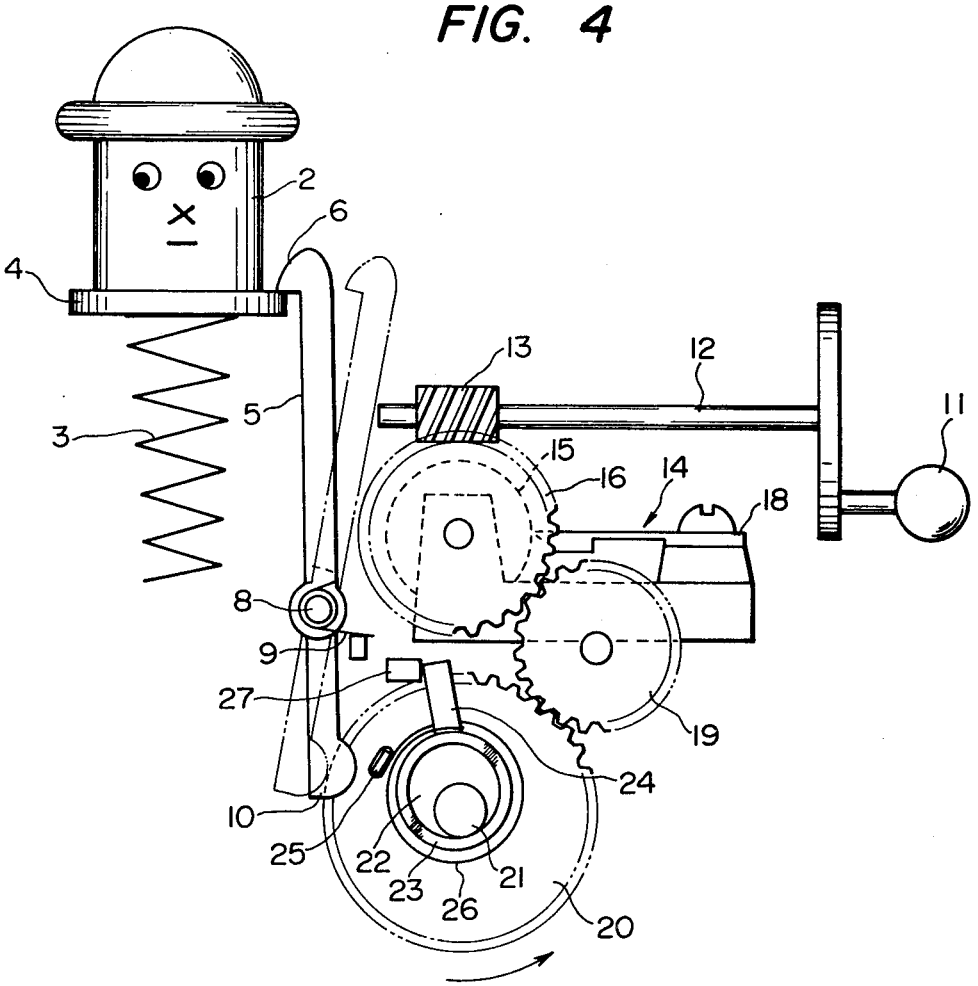
FIG. 4 is a side elevational view of an essential part of an instantaneous rotation device shown in FIG. 3.
Figure 5:
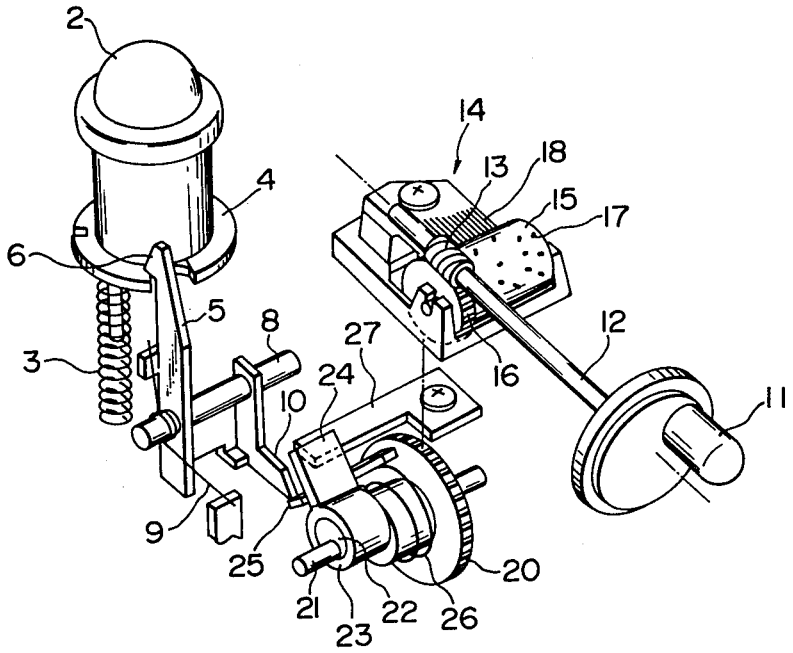
FIG. 5 is a perspective view of the device shown in FIG. 4.

The invention will be more fully understood from the following description of the preferred embodiments taken in conjunction with the accompanying drawings. Referring to a first embodiment of the invention applied to a jack-in-the-box shown in FIGS. 3 to 5, a head 2 fits in an aperture formed in the upper side of a jack-in-the-box 1. The head is biased upwardly by a coiled spring 3. A flange 4 provided at the lower end of the head is adapted to be engaged by a hook 6 formed at the upper end of the lever-shaped movable member 5 when the head 2 is lowered overcoming the force of the coiled spring 3. The movable member 5 is engaged with a support shaft 8 which in turn is rotatably secured to a stationary member (not shown) such as a constituent of the jack-in-the-box. The movable member is rotatingly biased by a torsion spring 9 which is wound around the support shaft 8 and retained at its one end by a stationary member so as to bring the hook 6 into engagement with the flange 4. A lower part 10 is formed at a lower end of the movable member 5. The lower end part 10 is made to project into the path of rotation of the projection 24 formed on a dog which will be mentioned later. The movable member 5 may be rotatably fitted to the support shaft 8. It is also possible to form the lower end part 10 integrally with the movable member. The flange 4 adapted to be engaged by the flange 4 may be provided at the inner side of the head.

A worm 13 is fixed to a rotary shaft 12 of the handle 11 projected from the jack-in-the-box 1. The worm 13 meshes with a gear 16 on the drum 15 of a music box 14. The drum 15 is provided on its outer peripheral surface with pins 17 adapted to pluck the vibration plates 18. The rotation of the gear 16 is transmitted to the gear 20 through an intermediate gear 19. It is possible to omit the intermediate gear 19 to permit the gears 16 and 20 to directly mesh each other.

The gear 20, which is adapted to be rotated manually through the handle 11, is fixed to a rotary shaft 21 on which is formed an eccentric cam 22. A dog 23 rotatably fits around the eccentric cam 22 to form a biasing means for the projection 24 provided on the dog. The gear 20 is provided with an abutting portion 25. A coiled spring 26 is retained at its both ends by the abutting portion 25 and the projection 24. A limiting member 27 is disposed to project into the path of rotation of the projection 24. A limiting member is fixed to a stationary member (not shown). The spring 26 biases the projection 24 into abutment with the abutting portion 25. For attaining a prompt motion of the projection 24, the position of the abutting portion in relation to the direction of the maximum eccentricity of the eccentric cam 22 is preferably determined such that the abutting portion 25 is located slightly ahead of the direction of the maximum eccentricity as viewed in the direction of rotation of the gear 20.

Figure 6:
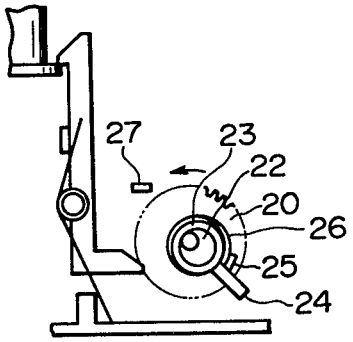
FIGS. 6 to 9 are illustrations of operation.
Figure 7:
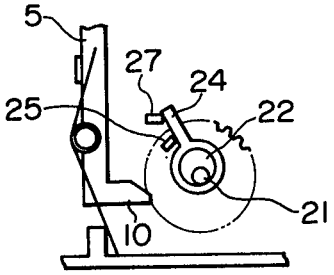
Figure 8:
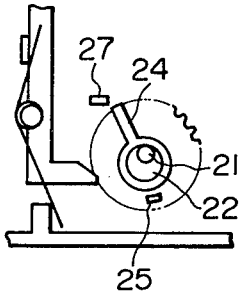
Figure 9:
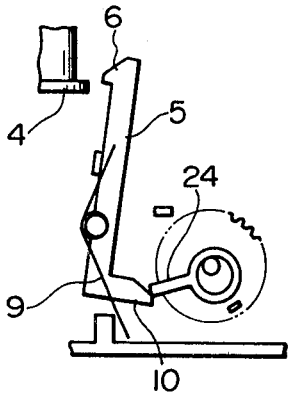

The operation of the first embodiment will be explained in connection with FIGS. 6 to 9. As the handle 11 is rotated in the clockwise direction, the drum 15 is rotated so that the pins 17 pluck the vibration plates 18 and, at the same time, the gear 20 is rotated counter-clockwise as shown in FIG. 6 so that the projection 24 of the dog 23 is brought into contact with the limiting member 27 at a position ahead of the direction of maximum eccentricity of the eccentric cam 22 as shown in FIG. 7. As a result, the abutting portion 25 is rotated while the projection 24 is being stopped so that the spring 26 is further energized. As the gear 20 is rotated further, the projection 24 is retracted towards the rotary shaft 21 as shown in FIG. 8 while being contacted by the limiting member 27. Then, as the end of the projection 24 is retracted apart from the limiting member 27, the projection 24 is rotated quickly in the counter-clockwise direction by the energy stored in the spring 26 so that the lower end part 10 of the movable member 5 is knocked as shown in FIG. 9 to instantaneously rotate the movable member in the clockwise direction overcoming the force of the spring 9. As a result, the hook 6 is disengaged from the flange 4 so that the head 2 is quickly projected upwardly to effect the operation of the coiled spring 3 to perform the function of the jack-in-the-box.

Then, the projection 24 is rotated until it abuts the abutting portion 25 by the action of the spring 26 and the projection 24 is moved ahead to the position where it does not contact the lower end part 10. Therefore, when the head 2 is depressed immediately after the operation of the jack-in-the-box, the movable member 5 is rotated clockwise by the force of the spring 9 to bring the flange 4 into engagement with the hook 6 so that the resetting of the movable member is never hindered even if the rotation of the teeth 20 caused by the manipulation of the handle is extremely slow.

Figure 10:
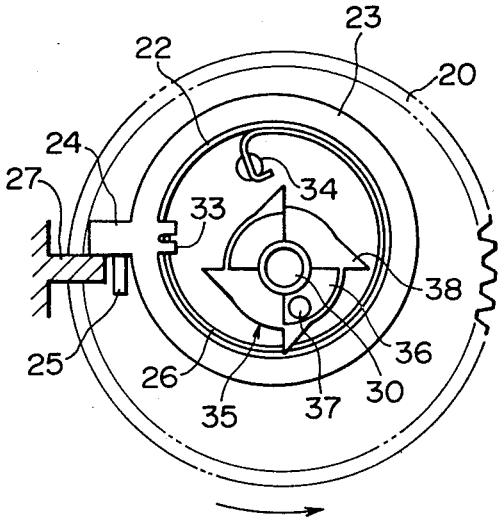
FIGS. 10 and 11 are sectional front elevational view and a sectional side elevational view of an automatic music switching mechanism of a music box to which the invention is applied.
Figure 11:
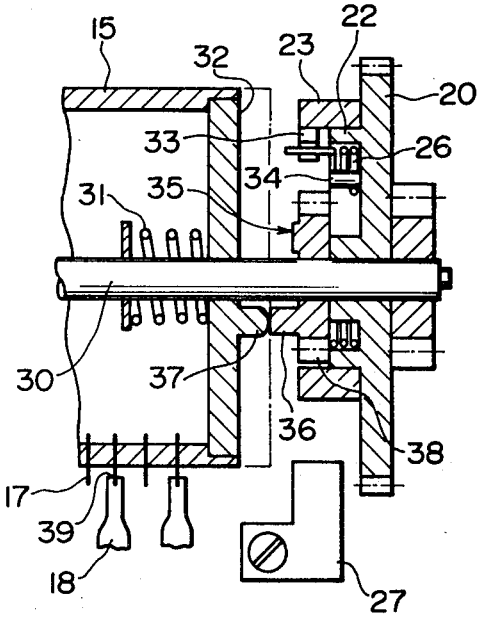

FIGS. 10 and 11 illustrate an instantaneous rotation device in accordance with a second embodiment of the invention, applied to a music box adapted to play two different musics with a single drum. A drum 15 is slidably carried by a drum shaft 30 but is prevented from rotating relatively to the latter. A side plate 32 of the drum is pressed to the right as viewed in FIG. 11 by means of a pressing spring 31. A gear 20 is fixed to the drum shaft 30. The gear 20 is adapted to be driven by a power source such as a spiral spring or a motor. An annular eccentric cam 22 is formed on the inner surface of the gear 20, facing the drum 15. An annular dog 23 rotatably fits around the eccentric cam 22. An outer projection 24 and an inner projection 33 are formed on the outer peripheral surface and the inner peripheral surface of the dog 23, respectively. An abutting member 25 is formed on the inner surface of the gear 20 outside the dog 23. A spring retainer 34 is formed to project from the inner surface of the gear 20 inside the eccentric cam 22. A coiled spring 26 is retained at its both ends by the spring retainer 34 and the inner projection 33, so as to bias the outer projection 24 of the dog into engagement with the abutting portion 25. As in the case of the first embodiment, the position of the abutting portion 25 in relation to the direction of the maximum eccentricity of the eccentric cam is determined such that the abutting portion 25 is located somewhat ahead of the direction of the maximum eccentricity as viewed in the direction of rotation. A limiting member 27 is fixed to a stationary member so as to project into the path of rotation of the outer projection 24. A movable member 35 having the form of a dent wheel is rotatably fitted around the drum shaft of the gear 20 adjacent to the drum 20. A projection 36 is provided to project from the end surface of the movable member 35, while a projection 37 protruded from the side plate 32 of the drum 15 is adapted to be depressed in the axial direction. A movable member 35 is adapted to be revolved while being held in sliding contact with the gear 20 by the force of the drum pressing spring 31, and to be rotated when the inner projection 33 is collided by the claw 38. The number of the claws 38 is a multiple of the projection 36. Pins 17 for the first music and pins 39 for the second music are alternatingly arranged on the outer peripheral surface of the drum 15 to pluck the vibration plates 18.

The operation of the second embodiment is as follows. FIGS. 10 and 11 illustrates the second embodiment in the state for playing the second music in which the drum 15 has been displaced to the left as viewed in FIG. 11 as a result of engagement between the projections 37 and 36. The gear 20 has been rotated to the position where the outer projection 24 of the dog 23 is contacted by the limiting member 27. As the gear 20 is further rotated from this position, the abutting portion 25 is moved ahead so that energy is stored in the spring 26. Then, the projection 24 is gradually retracted inwardly radially due to the eccentricity. As a result, when the projection 24 leaves the limiting member 27 the dog 23 is quickly rotated to move the claws 38 of the movable member 35 in the rotational direction immediately, so that the projections 36 and 37 are disengaged from each other. As a result of this disengagement, the drum 15 is slid by the force of the spring 31 to the right to take a position shown by imaginary line in FIG. 11 so that the pins 18 may pluck the vibration plates 18 for the first music. Then, as the gear 20 makes a further rotation, the projection 33 instantaneously rotates the claws 38 of the movable member 35 to thereby lift the projection 37 by the projection 36 so that the apparatus as a whole is switched to the positions shown in FIGS. 10 and 11. The switching between the first and the second musics is made within a short period of time correcponding to the rotation angel of about 1°, and the music box can turn to the playing of the next music instantaneously. It is, therefore, possible to play a long music by dividing the music into two parts and playing these parts successively.

As has been described, according to the invention, a movable member is quickly operated by a dog which is actuated by energy stored in a spring, so that the operation caused by the movable member can be attained instantaneously. Furthermore, when the movable member is reset to the old position, the projection of the dog is moved ahead so as to allow the movable member to be reset without being interfered by the projection thereby to permit the movable member to perform another kind of operation, while preparing for the next operation of the dog. Thus, the invention provides an instantaneous rotation device which offers various practical advantages with a simple construction.

What is claimed is:

1. An instantaneous rotation device comprising: a gear (20) driven by a power source; an abutting portion (25) formed on said gear; a dog (23) rotatably provided to said gear and having a projection (24); means (26) for biasing said projection (24) into abutment with said abutting portion (25); a stationary limiting member (27) projecting into a path of rotation of said projection (24); means (22) for eccentrically moving said projection (24) out of engagement with said stationary limiting member (27); and a movable member (5, 35) biased to project into the path of rotation of said projection (24) ahead of said limiting member (27) in the direction of rotation of said gear (20); wherein as said projection (24) abuts against said limiting member (27), said biasing means (26) is energized, and as said projection (24) is released from said limiting member (27) by said eccentrically moving means (22), said projection (24) instantaneously rotates said movable member (5, 35) by making use of the energy stored in said biasing means.

2. An instantaneous rotation device for a music box (14) including a drum (15), comprising: a gear (20) rotated as said drum is rotated; an abutting portion (25) formed on said gear; a dog (23) rotatably provided to said gear and having a projection (24); means (26) for biasing said projection (24) into abutment with said abutting portion (25); a stationary limiting member (27) projecting into a path of rotation of said projection (24); means (22) for eccentrically moving said projection (24) out of engagement with said stationary limiting member (27); and a movable member (5, 35) biased to project into the path of rotation of said projection (24) ahead of said limiting member (27) in the direction of rotation of said gear (20); wherein as said projection (24) abuts against said limiting member (27), said biasing means (26) is energized, and as said projection (24) is released from said limiting member (27) by said eccentrically moving means (22), said projection (24) instantaneously rotates said movable member (5, 35) by making use of the energy stored in said biasing means.

3. An instantaneous rotation device for a jack-in-the-box type music box having a jack-part biased to be retracted in said music box and means for retaining said jack-part in the retracted position, comprising: a gear (20) adapted to be driven by a power source; an abutting portion (25) formed on said gear; a dog (23) rotatably provided to said gear and having a projection (24); means (26) for biasing said projection (24) into abutment with said abutting portion (25); a stationary limiting member (27) projecting into a path of rotation of said projection (24); means (22) for eccentrically moving said projection (24) out of engagement with said stationary limiting member (27); and a movable member (5) biased to project into the path of rotation of said projection (24) ahead of said limiting member (27) in the direction of rotation of said gear (20), said movable member being adapted to release said retaining means from the retracted position; wherein as said projection (24) abuts against said limiting member (27), said biasing means (26) is energized, and as said projection (24) is released from said limiting member (27) by said eccentrically moving means (22), said projection (24) instantaneously rotates said movable member (5) by making use of the energy stored in said biasing means.

4. The device of any one of claims 1 to 3, said means for biasing including a coiled spring (26) coupled at one end to said gear (20) and at the other end to said dog (23).

5. The device of any one of claims 1 to 3, said means for eccentrically moving including a cam member eccentrically fixed relative to said gear (20).

6. The device of claim 5, in which said cam member is a cylindrical cam (22).

7. The device of claim 5, in which said cam member is an annular cam (22).

8. An instantaneous rotation device for a jack-in-the-box type music box having a jack-part biased to be retracted in said music box, means for retaining said jack-part in the retracted position, and a drum (15) having at one end a drive gear (16) comprising: a gear (20) adapted to be driven by said drive gear (16); an abutting portion (25) formed on said gear; a dog (23) rotatably provided to said gear and having a projection (24); means (26) for biasing said projection (24) into abutment with said abutting portion (25); a stationary limiting member (27) projecting into a path of rotation of said projection (24); a cylindrical cam (22) for eccentrically moving said projection (24) out of engagement with said stationary limiting member (27); and a movable member (5) biased to project into the path of rotation of said projection (24) ahead of said limiting member (27) in the direction of rotation of said gear (20), said movable member (5) being adapted to release said retaining means from the retracted position; wherein as said projection (24) abuts against said limiting member (27), said biasing means (26) is energized, and as said projection (24) is released from said limiting member (27) by said cylindrical cam (22), said projection (24) instantaneously rotates said movable member (5) by making use of the energy stored in said biasing means.

9. An instantaneous rotation device for a music box having a drum (15) biased to be axially move in one direction, and change-over means for changing over modes of play, comprising: a gear (20) adapted to be driven by a power source; an abutting portion (25) formed on said gear; a dog (23) rotatably provided to said gear and having a first projection (24) and a second projection (33); means (26) for biasing said projection (24) into abutment with said abutting portion (25); a stationary limiting member (27) projecting into a path of rotation of said first projection (24); an annular cam (22) for eccentrically moving said first projection (24) out of engagement with said stationary limiting member (27); and a rotatable member (35) biased to project into the path of rotation of said second projection (33) ahead of said limiting member (27) in the direction of rotation of said gear (20), said rotatable member (35) being adapted to release said retaining means (4) from the retracted position; wherein as said first projection (24) abuts against said limiting member (27), said biasing means (26) is energized, and as said first projection (24) is released from said limiting member (27) by said annular cam (22), said second projection (35) instantaneously rotates said rotatable member (35) by making use of the energy stored in said biasing means.

* * * * *